US005127643A

United States Patent [19]

DeSanctis et al.

[11] Patent Number: 5,127,643

[45] Date of Patent: Jul. 7, 1992

[54] AUTOMATIC COPY SHEET SELECTION DEVICE

[75] Inventors: Anthony T. DeSanctis, Rochester; Barry P. Mandel, Fairport; Francesca A. Barrientos, Rochester; Richard A. VanDongen, Newark; David R. Kamprath, Webster, all of N.Y.

[73] Assignee: Xerox Corporation, Stamford, Conn.

[21] Appl. No.: 777,042

[22] Filed: Oct. 16, 1991

[51] Int. Cl.[5] ..... B65H 3/44

[52] U.S. Cl. ..... 271/9

[58] Field of Search ..... 271/9; 250/110, 559

[56] References Cited

U.S. PATENT DOCUMENTS

| | | | |
|---|---|---|---|
| 4,248,528 | 2/1981 | Sahay | 355/14 R |
| 4,388,008 | 6/1983 | Greene et al. | 271/9 |
| 4,609,283 | 9/1986 | Murata et al. | 355/14 R |
| 4,804,997 | 2/1989 | Mizude et al. | 271/9 |
| 4,920,384 | 4/1990 | Okamoto | 355/311 |
| 4,937,592 | 6/1990 | Akao et al. | 346/134 |

FOREIGN PATENT DOCUMENTS

| | | | |
|---|---|---|---|
| 161647 | 7/1987 | Japan | 271/9 |
| 182634 | 7/1990 | Japan | 271/9 |

*Primary Examiner*—Robert P. Olszewski
*Assistant Examiner*—Steven M. Reiss
*Attorney, Agent, or Firm*—Kevin R. Kepner

[57] ABSTRACT

An automatic copy paper selecting device that chooses the proper type of copy sheet based on the paper weight of the sheets of the original document without the necessity of utilizing coded control sheets or other operator input. A paper weight sensor in the document handler determines the weight of each original sheet and sends a signal to a programmable controller which then selects the proper copy sheet feed tray based on preprogrammed parameters.

10 Claims, 2 Drawing Sheets

AUTOMATIC COPY SHEET SELECTION DEVICE

Figure 1:
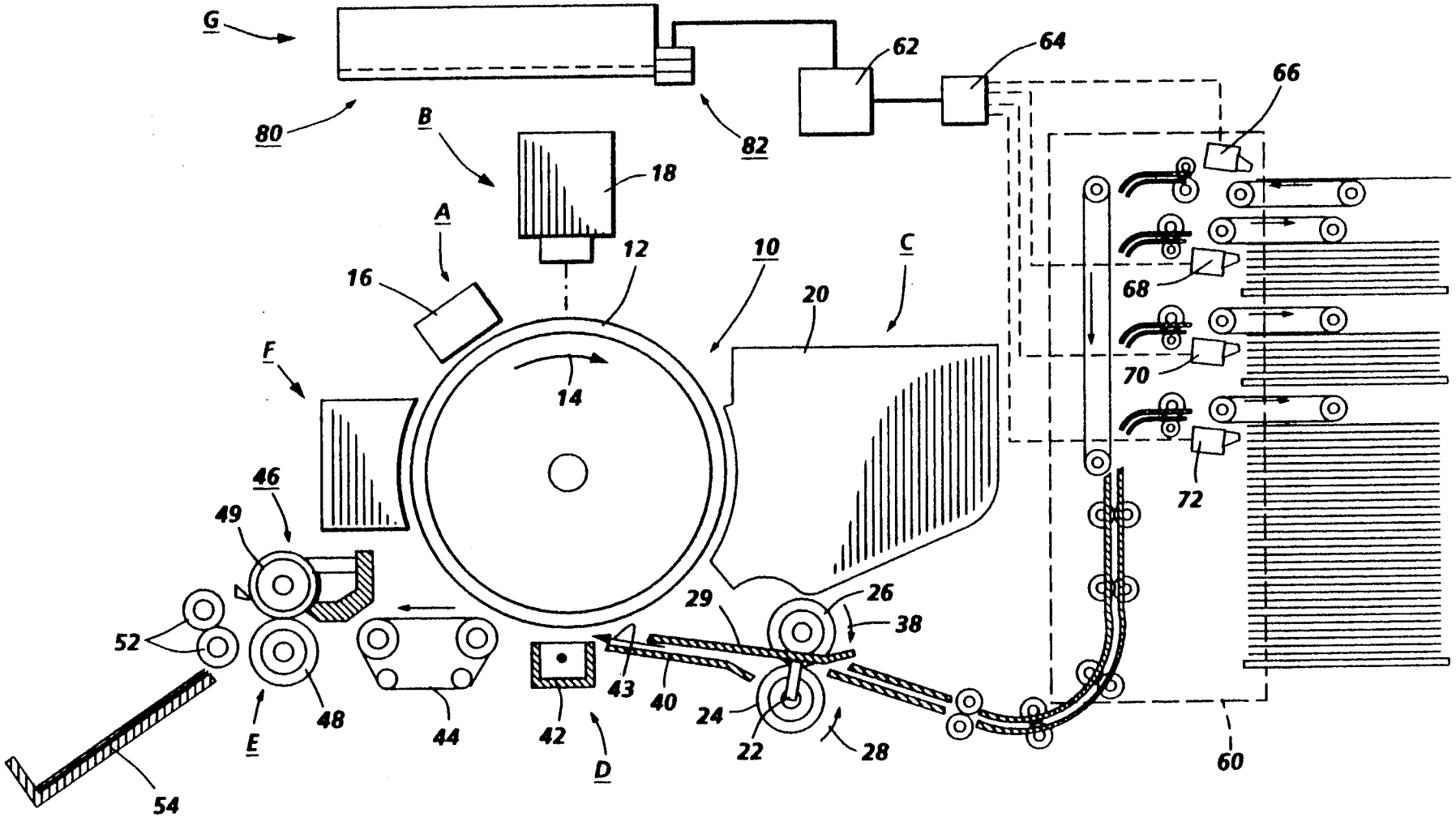

This invention relates generally to an electrophotographic printing machine, and more particularly concerns the automatic selection of copy sheets based on the paper weights of the original documents.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, particularly for the faster and more sophisticated xerographic and other copiers now available, it is increasingly desirable to provide for fully automatic handling of the original documents being coped and the copies being made, in order to more effectively utilize the higher speeds of the machines. It is further desirable and known to handle a wide variety of original documents with an integral document feeder, including documents with information on one side (simplex) or both sides (duplex). It is desirable and known to provide documents from any of these documents which are selectively either simplex or duplex, and put out in pre-collated or post-collated sets in sorted, stacked and/or offset or bound form. It is known to provide document feeders for this purpose which are semiautomatic or which are fully automatic and which are selectable between single or multiple document set recirculation modes of operation. It is also desirable and known for the copier to be controllable by the operator to provide for variable magnifications or reductions and other copying adjustments such as image density or darkness, etc. Other desirable operator selectable features include the automatic inserting of cover or insert sheets of various materials, sizes, shapes or colors into proper positions or locations in the copied sets.

Due to the increase in known functions and capabilities of copiers, there has been an increased need for the operator to make various selections or choices to fully utilize the features of today's copiers. Unlike simple copiers, in which the only visible operator controls may be a copy count selector for the number of copies, and on, off, and start buttons, a modern sophisticated copier may present the operator with a large and confusing display of additional switches, buttons, dials, lights, instructions and other user interfaces. To fully utilize the capabilities of the copying machine, it may be necessary for the operator to locate and actuate various combinations of these manual switches and controls before the copying can commence. Additionally, the operator may have to repeat the entire sequence of manual switch control steps for each desired copying jog, even if that job is the same as ones previously run. If different copying functions or features are to be provided for different documents in a set or stack of documents to be copied, it may be additionally necessary to interrupt each copying run and the feeding of the documents several times in order to change or reset various switch settings to the different processing desired.

One of the means used in an effort to reduce the required operator interface has been the use of preprinted and operator marked control sheets to send signals to the copying machine. Control sheets can be used in several different manners. In a first embodiment, a control sheet is entered before any of the original documents and give a series of instructions to the copying machine such as the number of copies in the set, when and where a cover or index should be inserted and can also provide for various internal adjustments to the machine based on the type of copy sheets being utilized as the stack is fed through the machine. In a second embodiment of control sheets, individual coded sheets are inserted into an original stack of documents and signify some sort of change within the stack such as insertion of a cover, or a divider, or some other change in the machine operation.

Another manner in which variations in copying functions can be effected is through the use of a programmable operator's console or station in which the operator can choose the number of copies, the type of copies and any special features to be inserted or adjustments to be made within a document set. One of the shortcomings of this type of system, however, is that each original document set must be pre-counted and each variation programmed into the copying machine thereby requiring a significant degree of training and/or operator skill.

It is an object of the present invention to provide a so-called intelligent machine which can recognize variations in an original document set and automatically adjust the copying machine accordingly. It is a further object of the present invention to enable variations in the copying functions, particularly with regard to special insertions, to be achieved without the requirement of a skilled or highly trained operator thereby enabling virtually anyone to use the copying machine to its full extent.

The following disclosures may be relevant to various aspects of the present invention:

U.S. Pat. No. 4,937,592; Patentee: Akao, et al.; Issued: Jun. 26, 1990.

U.S. Pat. No. 4,920,384; Patentee: Okamoto; Issued: Apr. 24, 1990.

U.S. Pat. No. 4,609,283; Patentee: Murata, et al.; Issued: Sept. 2, 1986.

U.S. Pat. No. 4,248,528; Patentee: Sahay; Issued: Feb. 3, 1981.

U.S. appl. Ser. No. 07/627,867; Inventor: Wong; Filed: Dec. 17, 1990; Allowed; Jan. 13, 1992.

The relevant portions of the foregoing disclosures may be briefly summarized as follows:

U.S. Pat. No. 4,937,592 discloses a device which utilizes encoded control sheets which operate the machine and select desired functions so as to provide the copying qualities selected.

U.S. Pat. No. 4,920,384 describes a copying machine which utilizes various sensors in the document handling device to detect size variations in the original documents and adjust the magnification of the copying machine accordingly.

U.S. Pat. No. 4,609,283 describes a copying apparatus having a control panel that can be enabled for subjectively programming copying functions while displaying same to the user. The user can store a certain code or program in correlation to a specific code indicia. The code indicia can then be placed on a document and inserted into the copying machine where the code indicia will be sensed and the pre-recorded functions repeated.

U.S. Pat. No. 4,248,528 discloses a copier control system in which preprinted and operator marked control sheets otherwise corresponding to the regular original document sheets being copied are fed together with those regular documents past an optical scanner connected to the copier controller. The document sheets are copied in the manner instructed by the control sheets without requiring manual inputs.

U.S. appl. Ser. No. 07/627,867 discloses a paper basis weight sensing device utilizing an infrared emitter and a phototransistor receptor to determine the weight of a sheet based upon the variance in output voltage of the phototransistor due to the sheet passing between the emitter and receptor.

In accordance with one aspect of the present invention, there is provided an apparatus for automatically selecting a copy sheet as a function of the weight of an original sheet, utilizing an original sheet weight detecting and signal generation device which causes the appropriate copy sheet to be selected based on the signal. In accordance with a second aspect of the present invention there is provided an electrophotographic printing machine of the type in which a copy sheet is selected as a function of the weight of an original document, utilizing an original sheet weight detecting and signal generation device which causes the appropriate copy sheet to be selected based on the signal.

Figure 2:
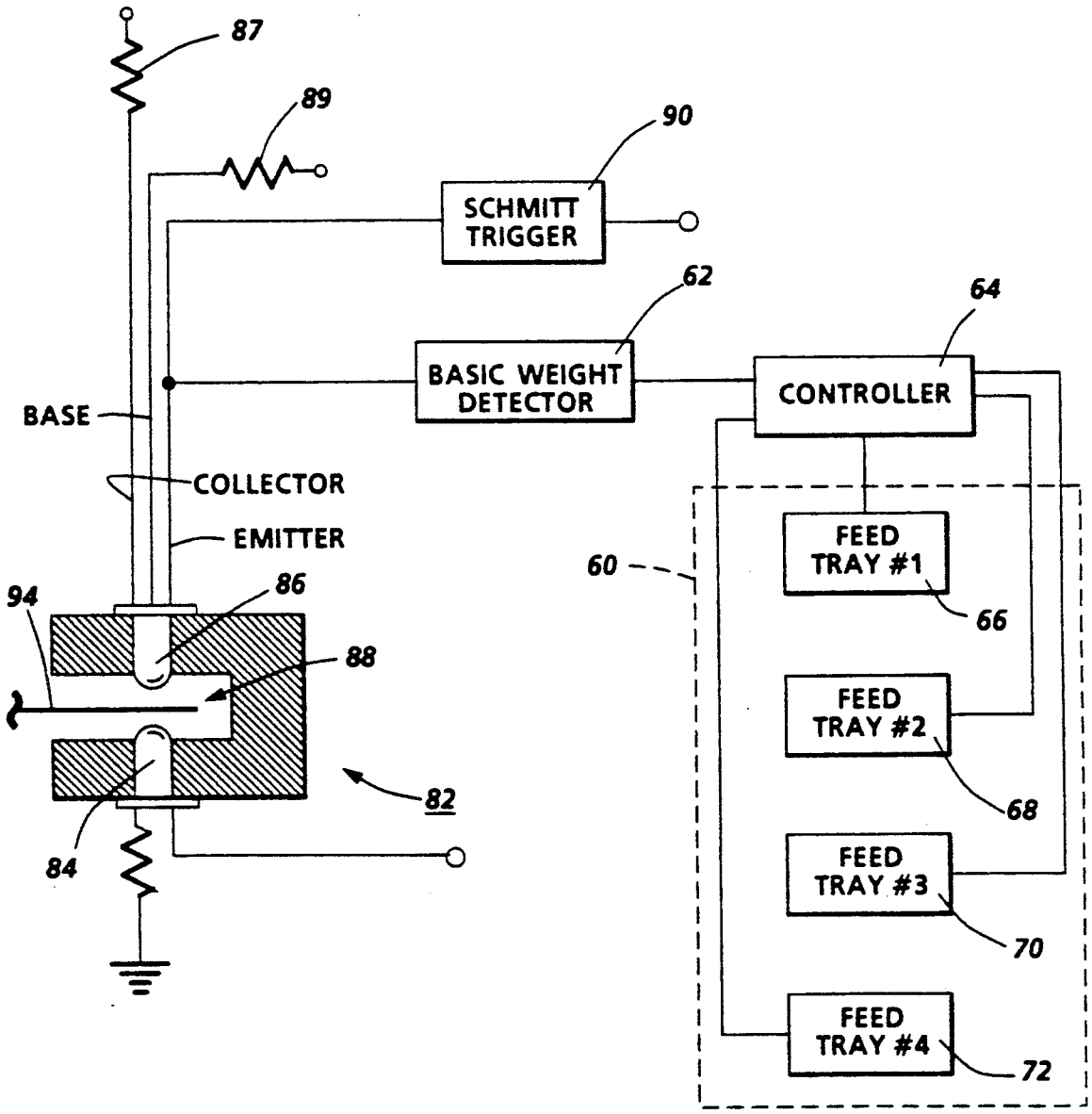

Other features of the present invention will become apparent as the following description proceeds and upon reference to the drawings, in which:

FIG. 1 is a schematic elevational view depicting an illustrative electrophotographic printing machine incorporating the automatic copy paper selecting apparatus of the present invention therein; and FIG. 2 is a schematic representation of a transmissive paper path sensor embodying the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for selecting copy sheets is particularly well adapted for use in the electrophotographic printing machine of FIG. 1, it should become evident from the following discussion that it is equally well suited for use in a wide variety of devices and is not necessarily limited in this application to the particular embodiment shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 60 to transfer station D. As will be described in greater detail below, a sensor 82, located in the original document handler 80 generally indicated by station G, relays a signal to a basis weight detector 62 which then cooperates with a controller 64 to choose the proper copy sheet from one of various feed trays 66, 68, 70, 72 and forwards it to registration roller 24 and idler roller 26. Registration roller 24 is driven by a motor (not shown) in the direction of arrow 28 and idler roller 26 rotates in the direction of arrow 38 since roller 24 is in contact therewith.

In operation, feed device 60 operates to advance a sheet from the selected tray into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the automatic sheet selection system in greater detail.

FIG. 2 shows a typical arrangement for such a transmissive sensor wherein the electrical signal from the phototransistor 86 is provided as an input to a Schmitt trigger 90 or any other suitable threshold device. The output signal of the Schmitt trigger, depending upon the input voltage applied to it, indicates the absence or presence of sheet 94 at the sensor location. As is customary with sensors of this type, in order to eliminate interference from stray light sources and to improve the signal to noise ratio, sensor 82 is equipped with optical fibers (not shown) to block visible light and pass only infrared wave lengths issuing from LED 84. Typically the infrared LED used for this purpose produces invisible light in the near IR region of 850–1000 nanometers wave length. The amount of light produced by the LED is substantially proportional to the amount of current supplied.

The sensor 82 and associated circuitry is generally of a type which heretofore has been used for enabling the sensor to provide timing and jam detection capabilities. Since the amount of IR energy which is transmitted through a sheet of paper is proportional to the basis weight of the paper, the output of the phototransistor can be correlated to a basis weight valve of a sheet 94 positioned in the detection zone 88 of the sensor 82. The thickness of the sheet is directly proportional to its basis weight, assuming compositional similarity.

Referring again to FIG. 2, the input signal provided by the emitter of phototransistor 86 is provided to a threshold device such as Schmitt trigger 90 which gives a signal indicative of the presence or absence of a sheet 94 at the detector, in a known manner. The analog output signal of phototransistor 86 is also provided to basis weight detector 62 for determining the basis weight of the paper sheet 94 positioned in the detection zone 88 of the detector 82. As the analog output signal of the phototransistor 86 is proportional to the basis weight of the sheet 94 passing through the detector 82, a model for determining the basis weight based on the size of the output signal can be developed, stored and compared with each generated signal.

The basis weight detector 62 can comprise a microcomputer including a CPU, a ROM and a RAM. Ideally, the detector 62 can be implemented in a general purpose microprocessor, which are typically used for controlling machine operations in electrophotographic reproduction machines, facsimile machines, printers and the like. Readings from the output signal of the photoresistor 86 can be stored in a RAM and a basis weight value can be derived in the CPU on the basis of the appropriate model stored in the ROM. The details of the function and development of the basis weight detector are discussed in copending U.S. application Ser. No. 07/627,867 which is incorporated herein by reference.

The output of the basis weight detector 62 can be utilized by a controller 64 for selecting the proper feed tray 66, 68, 790, 72 containing copy sheets corresponding to the original documents. The basis weight of the original document can be used in various ways to select the copy sheet, i.e. different color copy sheets may correspond to certain weights, the same weight copy sheet as the original may be selected, or any other variation of copy sheets deemed necessary in the particular application may be implemented. In some applications it will be necessary to pre-circulate the original documents to determine their basis weight, as due to the length of the copy sheet paper path, the copy sheet is committed before the original document is imaged.

In recapitulation, the automatic copy sheet selecting device includes a paper weight sensor to determine the basis weight of the original document. A signal from the sensor is utilized by a controller to select the feed tray containing copy sheets corresponding to the original document without additional operator input.

It is, therefore, apparent that there has been provided in accordance with the present invention, an automatic copy sheet selector that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for automatically selecting a copy sheet as a function of the weight of an original sheet, comprising:

means for detecting the weight of the original sheet and generating a signal proportional thereto; and means, responsive to the generated signal from said detecting means, for selecting a sheet.

2. An apparatus as described in claim 1 wherein said detecting means comprises:

an infrared emitter; and a phototransistor receptor being positioned to receive energy transmitted through said original copy sheet from said infrared emitter.

3. An apparatus as described in claim 2 wherein said selecting means comprises a programmable controller, which selects the copy sheet as a function of the output signal from said phototransistor receptor and a pre-selected reference.

4. An apparatus as described in claim 3, further comprising means for advancing the original sheet along a pre-selected path of travel with said phototransistor receptor and said infrared emitter being opposed from one another with the original sheet passing therebetween.

5. An apparatus according to claim 1, wherein said detecting means indicates the absence or presence of the original sheet.

6. A printing machine according to claim 1, wherein said detecting means indicates the absence or presence of the original sheet.

7. An electrophotographic printing machine of the type in which a copy sheet is selected as a function of the weight of an original document, wherein the improvement comprises:

means for detecting the weight of the original sheet and generating a signal proportional thereto; and means responsive to the generated signal from said detecting means for selecting a sheet.

8. A printing machine as described in claim 7 wherein said detecting means comprises:

an infrared emitter; and a phototransistor receptor being positioned to receive energy transmitted through said original copy sheet from said infrared emitter.

9. A printing machine as described in claim 8 wherein said selecting means comprises a programmable controller, which selects the copy sheet as a function of the output signal from said phototransistor receptor and a pre-selected reference.

10. A printing machine as described in claim 9, further comprising means for advancing the original sheet along a pre-selected path of travel with said phototransistor receptor and said infrared emitter being opposed from one another with the original sheet passing therebetween.

* * * * *